US006109830A

United States Patent [19]

de Baan

[11] Patent Number: 6,109,830

[45] Date of Patent: Aug. 29, 2000

[54] RISER SYSTEM FOR CONNECTING A SEABED INSTALLATION WITH A FLOATING VESSEL

[75] Inventor: Jacob de Baan, BH Maassluis, Netherlands

[73] Assignee: Bluewater Terminal Systems N.V., Netherlands Antilles

[21] Appl. No.: 09/138,810

[22] Filed: Aug. 21, 1998

[30] Foreign Application Priority Data

Oct. 7, 1997 [GB] United Kingdom ..... 9721258

[51] Int. Cl.[7] ..... F16L 1/12

[52] U.S. Cl. ..... 405/170; 405/169; 405/172; 166/341; 166/344

[58] Field of Search ..... 166/340, 341, 166/394, 395, 347, 367, 363; 405/173, 170, 169, 158, 224.2, 223.1, 195.1, 224.3, 224.4

[56] References Cited

U.S. PATENT DOCUMENTS

| | | | |
|---|---|---|---|
| 3,376,708 | 4/1968 | Hindman | 405/169 |
| 3,710,859 | 1/1973 | Hanes et al. | 166/344 |
| 4,493,590 | 1/1985 | Ayers et al. | 405/170 |
| 4,848,949 | 7/1989 | Castel | 405/169 |
| 4,906,137 | 3/1990 | Maloberti et al. . | |
| 5,807,027 | 9/1998 | Ostergaard | 405/170 |

FOREIGN PATENT DOCUMENTS

| | | |
|---|---|---|
| 2 206144A | 6/1988 | United Kingdom . |
| 2 296904A | 3/1995 | United Kingdom . |

*Primary Examiner*—David Bagnell
*Assistant Examiner*—Frederick L. Lagman
*Attorney, Agent, or Firm*—Fulwider Patton Lee & Utecht, LLP

[57] ABSTRACT

A riser system for connecting a seabed installation to a floating vessel consists of first and second fluid conveying conduits (13,14) connected by an articulated joint (7). In a standby condition the articulated joint (7) is anchored to the seabed, the two conduits (13,14) are not in fluid communication with one another and the upper conduit (13) rises substantially vertically with the aid of a buoyancy device (9). In use, the upper conduit (13) is pulled in to a floating vessel, thereby releasing the articulated joint (7) from the anchor (8) and allowing the joint to pivot in order to connect the upper and lower conduits (13,14) to allow passage of fluid therethrough.

18 Claims, 6 Drawing Sheets

FIG. 6a.
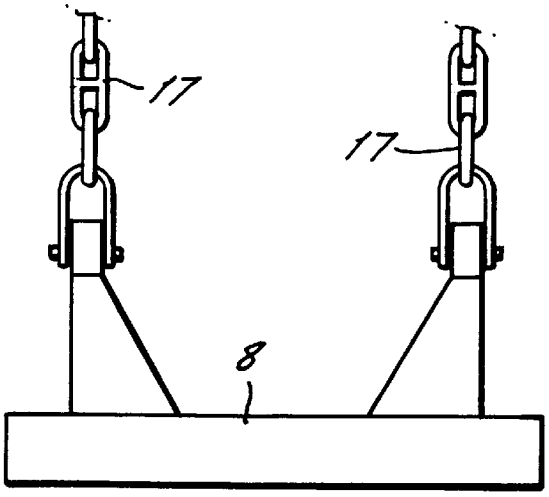
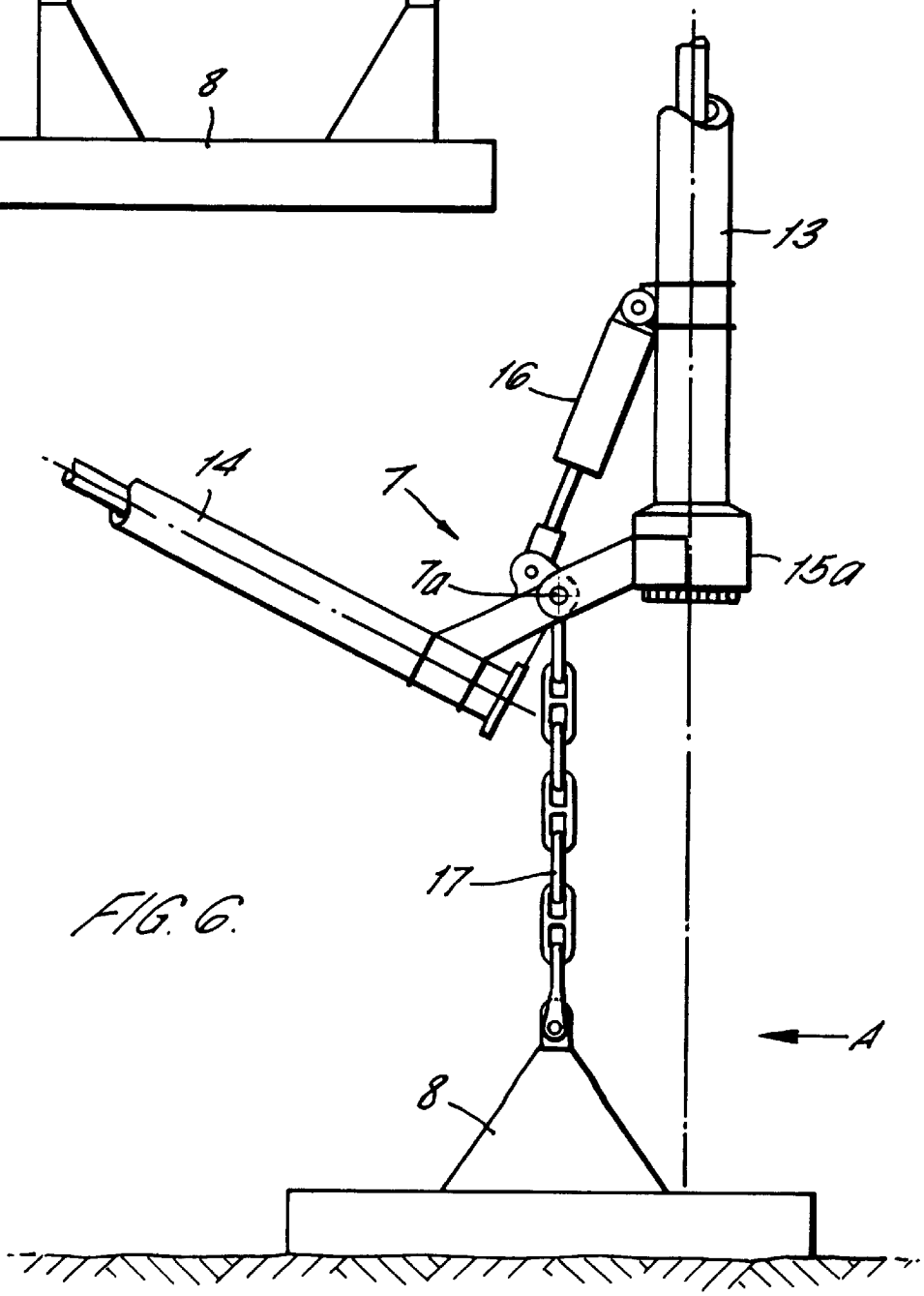
FIG. 6.

RISER SYSTEM FOR CONNECTING A SEABED INSTALLATION WITH A FLOATING VESSEL

The present invention relates to a riser system used to convey fluids between a seabed installation such as an oil well and a floating production vessel on the sea surface.

As oil production is moved into ever deeper waters in search of new fields, the need to have more robust riser systems which connect the floating production vessels to the seafloor increases. This robustness pertains to factors such as the need for large diameter pipes capable of withstanding high pressures and providing extremely high thermal insulation properties.

A possible solution is the use of double walled steel pipes, in which the inner pipe conveys the well fluids while the outer pipe contributes to the thermal efficiency by allowing an air gap between the two pipe walls. This type of pipeline has been applied in the oil industry in static applications and is now also being considered for dynamic applications, i.e those in which the pipeline is directly suspended from a floating production vessel.

A major drawback with the application of dynamic steel pipe risers is that the installation of these risers can only be done once the production vessel is in the appropriate location. This means that such installation works are on the critical path to oil production in terms of schedule and hence have a negative impact on the economic application of such dynamic risers.

This drawback is primarily due to the fact that the riser geometry does not allow bending radii below a certain limit and to control these radii it is essential for the top of the riser to be continuously supported. Hence, there is the need for the production vessel to be anchored on site to receive and support the riser as the latter is installed.

It is the objective of the present invention to provide an apparatus and method which allows a dynamic riser to be installed prior to the arrival of a production vessel and to effectively abandon the riser in a standby condition until such time as the production vessel is anchored in the field. At that point, only a simple pull-in operation is then required to secure the connection between the vessel and the riser.

The invention reduces the time to production to a matter of days rather than weeks and avoids the need to mobilise an installation vessel which would otherwise be required to install the riser in the close vicinity to the production vessel.

Accordingly, the present invention provides a riser system for connecting a seabed installation to a floating vessel, comprising a first conduit for conveying fluid and which is attachable at a first end to a seabed installation and comprises connector means at a second end, a second conduit for conveying fluid and which is attachable at a first end to a floating vessel and comprises connector means at a second end which is engageable with the connector means of the first conduit to allow fluid communication between the first and second conduits, articulation means joining the first and second conduits to allow relative rotation therebetween about a pivot axis whereby the first and second conduits are movable into alignment with one another to allow mating engagement of the respective connector means and out of alignment with one another to allow disengagement of the respective connector means.

Preferably, the system further comprises anchor means operable to anchor the articulation means adjacent the seabed.

The anchor means may comprise a seabed installation which is releasably engageable with the first or second conduit.

Alternatively, the anchor means may comprise a ballast weight which is releasably attached to the articulation means.

In this case, the ballast weight is preferably secured to the articulation means at a location displaced from the pivot point.

Conveniently, buoyancy means is secured to the first end of the second conduit to allow it to float in a substantially vertical position above the anchor means.

Buoyancy means may also be secured to the first conduit between its first and second ends.

Conveniently, actuator means may be provided which is operable to cause relative rotation of the first and second conduits about the pivot axis. This actuator means may comprise a hydraulic ram.

Both the first and second conduits may consist of double skinned pipes.

In another aspect of the invention, there is provided a method of assembling a riser system for connecting a seabed installation with a floating vessel comprising the steps of:

a) providing first and second conduits each having first and second ends;

b) providing mating connector means at the respective second ends of the first and second conduits;

c) providing articulation means joining said first and second conduits adjacent said second ends to allow relative rotation about a pivot axis whereby the first and second conduits are movable into alignment with one another to allow mating engagement of the respective connector means and out of alignment with another to allow disengagement of the respective connector means; and d) attaching the first end of the first conduit to a seabed installation.

Preferably the method further comprises step of anchoring the articulation means adjacent the seabed with anchor means.

The method may also comprise the step of providing buoyancy means at the first end of the second conduit to allow the second conduit to float in a substantially vertical position above the anchor means.

Conveniently, the method further comprises the step of raising the first end of the second conduit to overcome said anchor means and to allow pivoting about the pivot axis to bring the connector means into mating engagement, and securing the first end of the second conduit to a floating vessel.

In one embodiment, the anchoring means is releasably engageable with the first or second conduit or the articulation means and the step of overcoming the anchor means comprises disengaging the respective conduit or the articulation means from the anchor means.

Ideally, the first and second conduits are dimensioned such that the articulation means is located at between 50% and 95% of the water depth below sea level.

The method may involve providing buoyancy means on the first conduit between the first and second ends.

The method may also include providing actuator means operable to assist relative rotation of the first and second conduits about the pivot axis.

The invention will now be described in detail, by way of example only, with the reference to the accompanying drawings in which:

FIG. 1 show a prior art arrangement of a dynamic riser;

FIG. 1*a* is a detail of FIG. 1 showing a typical double skinned riser pipe;

FIG. 2 shows a dynamic riser arrangement in accordance with the present invention;

FIG. 3*a* shows the riser arrangement of FIG. 2 installed in the standby condition awaiting arrival of a production vessel;

FIG. 3*b* shows an alternative configuration of the riser arrangement of FIG. 3*a;*

FIG. 6 is a second embodiment of articulation means provided in the riser; and FIG. 6*a* is a view of the anchoring arrangement of FIG. 6 in a direction indicated by arrow A.

Figure 1:
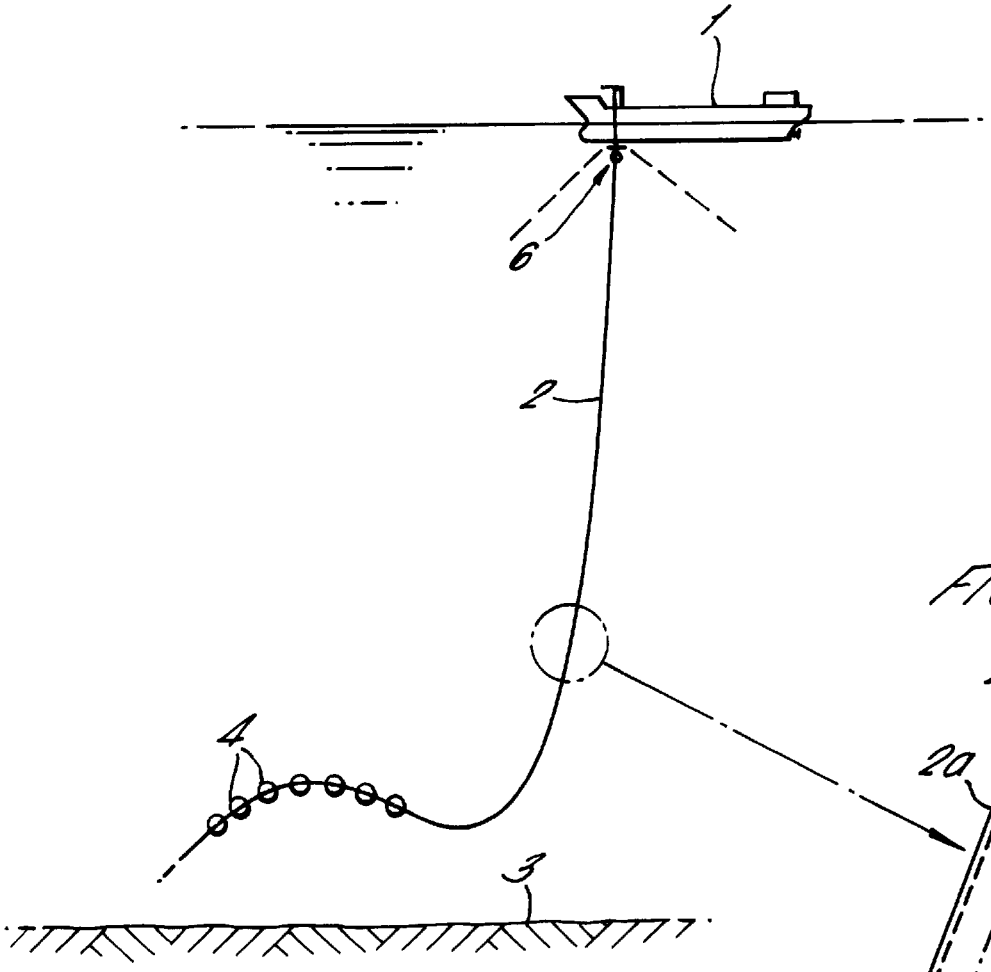

FIG. 1 shows a conventional dynamic riser layout. A production vessel 1 floating on the sea surface is shown supporting one riser 2, although in practice the vessel usually supports five to ten risers at the same time. The riser 2 extends in a generally catenary configuration to the seabed 3 where it is connected to a production well (not shown). However, conventional buoyancy aids 4 may be provided on the lower portion of the riser 2 as shown.

Figure 1A:
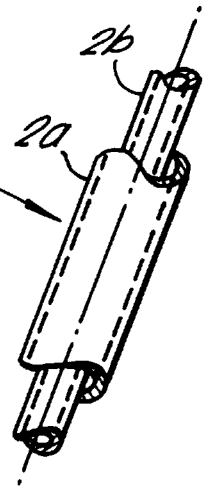

As the detailed view in FIG. 1*a* illustrates, the riser 2 is typically a double skinned structure, usually made of steel and having an outer wall 2*a* and a spaced inner wall 2*b*.

It is clear from the riser configuration shown in FIG. 1 that if the top 6 of the riser 2 is not supported and held in position then any force, for example sea currents, exerted on the structure in a direction perpendicular to the plane of the drawing, may cause large displacements creating the risk of interference with other risers and anchor lines employed in the same field. Also, without support from a floating vessel, the weight of the riser 2 may cause unacceptably large bending radii in the riser.

Figure 2:
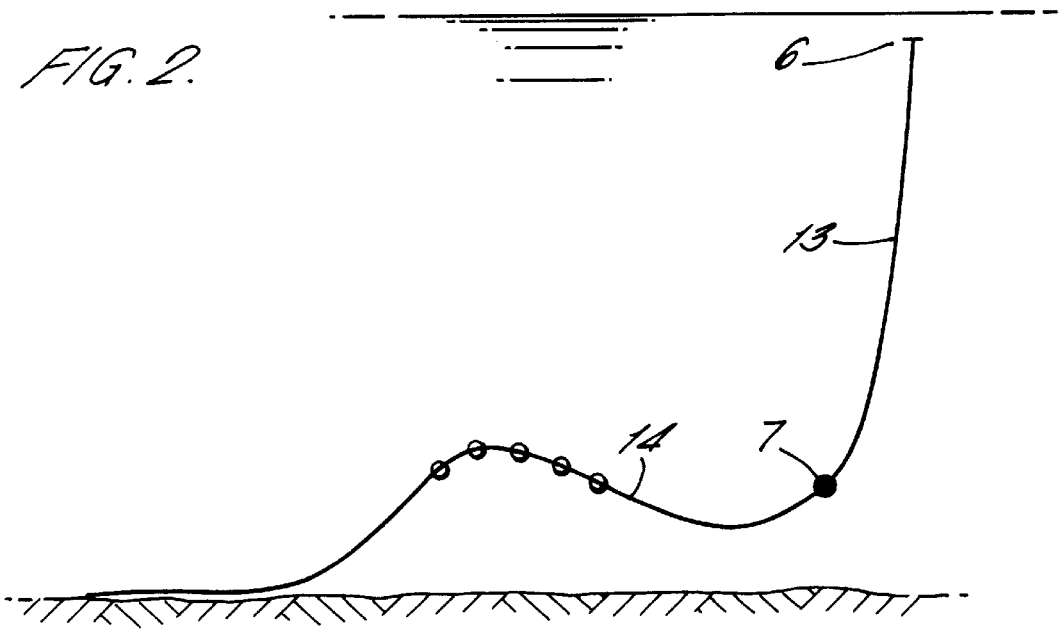

FIG. 2 shows a riser configuration in accordance with the present invention. It is similar in overall configuration but the system now includes an articulated joint 7 separating the riser 2 into an upper section 13 and a lower section 14. Both the upper and lower sections 13,14 may be of a double skinned type mentioned above, of steel or other materials, or any other desired type of riser. The articulated joint 7 is preferably located at between 50% and 95% of the water depth below sea level.

Figure 3A:
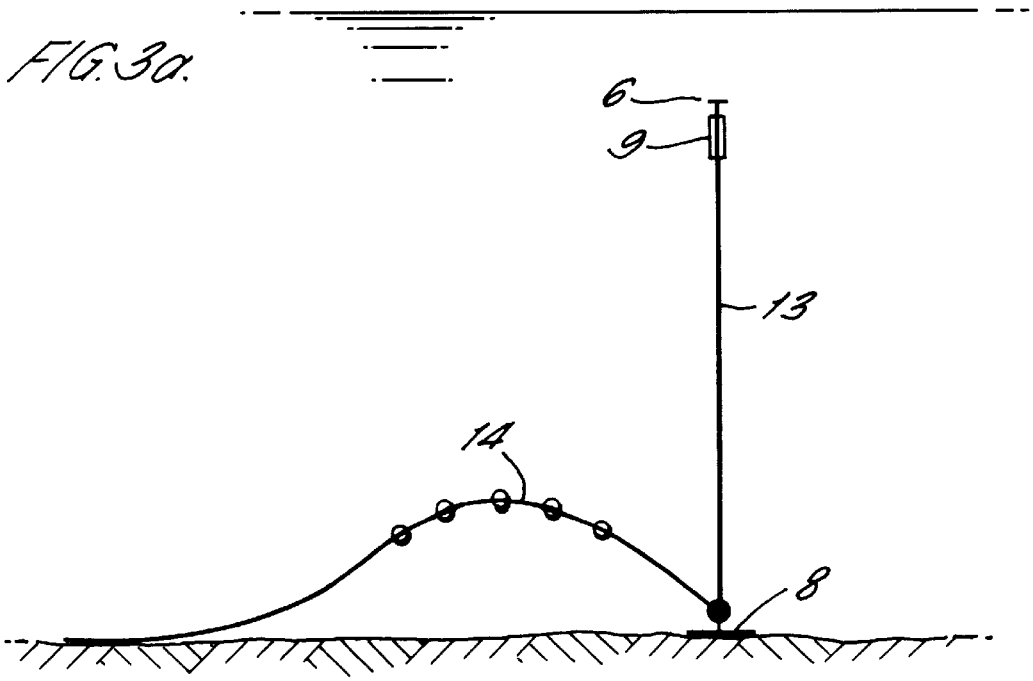
Figure 3B:
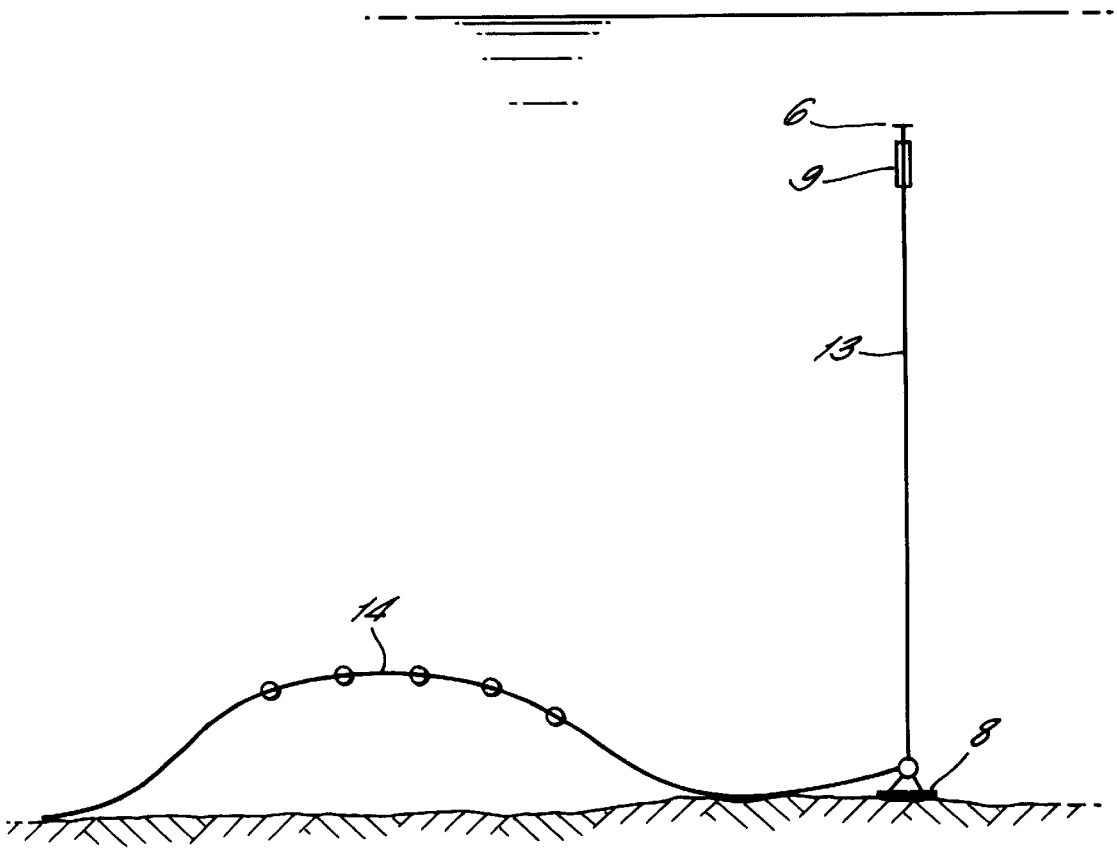

The articulated joint 7 allows the configuration of the riser 2 to be modified as shown in FIGS. 3*a* and 3*b* to provide a standby condition in which the riser is installed but can be stabilised and left to await arrival of a production vessel.

In order to stabilise the riser 2 as shown in FIG. 3*a*, an anchor means 8 is attached in the vicinity of the articulated joint 7, which then anchors the entire assembly to the seabed 3 at a location spaced from the attachment of the lower end of the riser 2 to the seabed oil well. A buoyancy member 9 of any desired type is attached to the riser top 6 and maintains the upper riser section 13 in a nominally vertical position above the anchor means 8.

In the alternative configuration shown in FIG. 3*b*, a portion of the lower riser section adjacent the anchor means 8 lies on the seabed, eg. by not placing buoyancy aids 4 on the lower riser section 14 close to the anchor means 8. In this way the weight of the lower riser section 14 itself helps to keep the upper riser section 13 in a nominally vertical position, especially when the anchor means 8 is released from the riser assembly, as described further below with reference to FIGS. 5, 6 and 6*a*.

Figure 4:
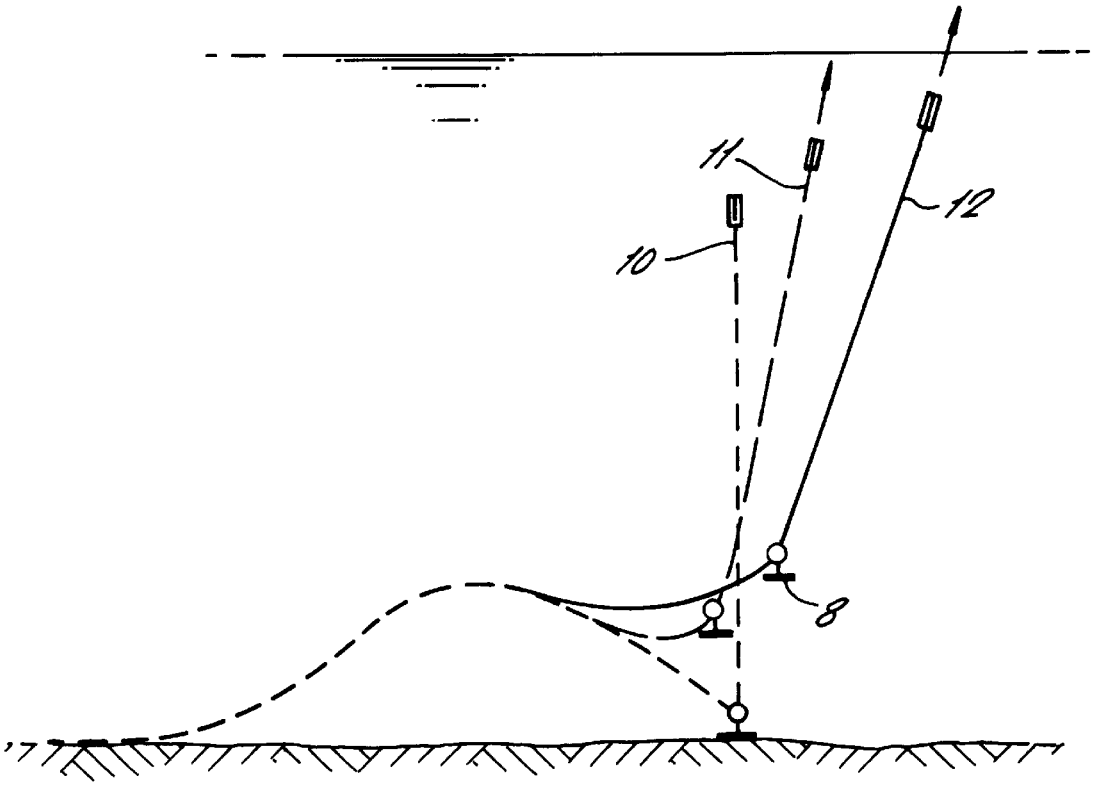
FIG. 4 shows the stages whereby the riser system of FIG. 3 is moved from the standby position into connection with a production vessel.

This riser assembly is now stabilised against environmental forces such as current. For final connection to a production vessel, the riser top 6 is pulled into the vessel, for example by a winch. As this is done, the riser 2 undergoes a gradual change in configuration as shown in FIG. 4 and indicated by reference numbers 10, 11 and 12. Preferably, the wire, cable or chain used to pull in the riser top 6 has a positive substantially vertical load on it during the pulling-in operation and the weight of the anchor means 8 and lower riser section 14 help to maintain this.

Figure 5:
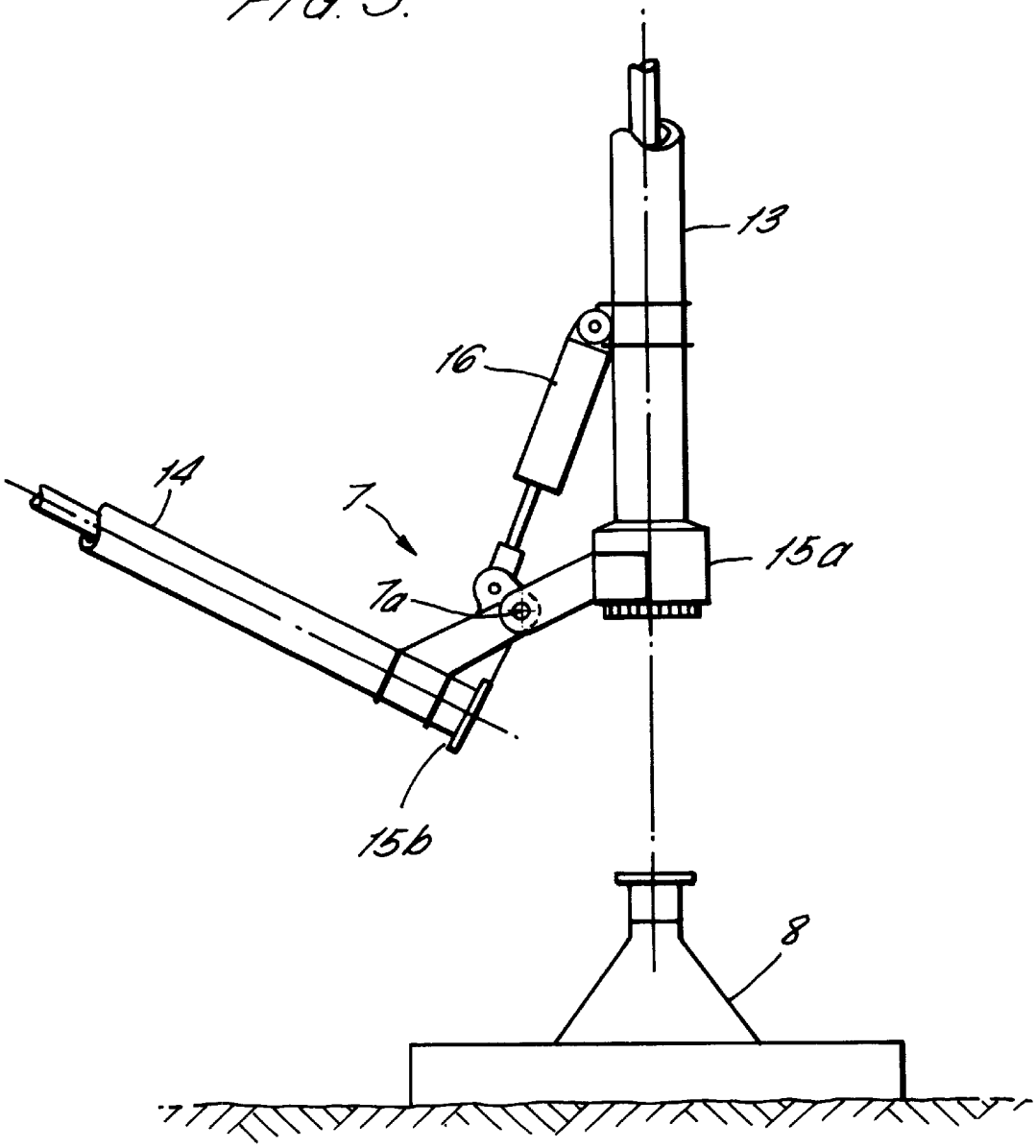
FIG. 5 is a first embodiment of articulation means provided in the riser.

FIG. 5 shows a detail of one embodiment of the articulated joint 7. The upper riser section 13 is fitted with a connector 15*a* as known in the industry and which can mate with a counterpart connector 15*b* fitted to the lower riser section 14. When the two connectors 15*a*,15*b* are connected they allow fluid communication between the interior of the upper and lower riser sections 13,14.

The articulated joint 7 connects the upper and lower riser sections 13,14 to one another and allows pivoting about an axis 7*a* which is perpendicular to the plane of the paper in FIG. 5.

Under the influence of the pulling-in operation shown in FIG. 4, as the upper riser section 13 is pulled upwardly, the gap and angle between the mating faces of connectors 15*a*,15*b* gradually reduces as both connectors pivot about the axis 7*a*. In order to assist in the full closure of the connectors 15*a*,15*b*, an actuator such as a hydraulic ram 16 may be fitted to assist as shown. Once the angle between the connectors 15*a*,15*b* is reduced to zero and the longitudinal axes of both upper and lower riser sections 13,14 are aligned with one another, the connectors 15*a*,15*b* mate to achieve a fluid type connection between the upper and lower riser sections 13,14.

The anchor means 8 may be configured such that the connector 15*a* of the upper riser section 13 can be moved vertically in order to engage and disengage directly with a fitting on the anchor means 8 as shown in FIG. 5. Upon pulling-in, connector 15*a* releases from the anchor means 8 and rises upward, allowing pivoting movement about axis 7*a* as described above. The anchor means 8 remains on the sea floor.

Alternatively, the anchor means 8 may be a ballast weight connected to the articulated joint 7 by one or more sections of chain or cable 17 as shown in FIG. 6. In this case, the chains or cable 17 are spaced laterally from the hinge point of the articulated joint 7 so as not to interfere with the pivotal movement. This displacement is shown in FIG. 6*a*. In this embodiment, upon pulling-in, the ballast weight may be raised up with the whole riser assembly as its weight is overcome by the upward force exerted on the upper riser section 13 until the connectors 15*a*,15*b* have engaged and the top 6 of the upper riser section 13 is secured to the vessel, at which time the anchor means 8 is released from the riser assembly. Alternatively, the anchor means 8 may be released as soon as the pulling-in operation commences.

It will be apparent to a person skilled in the art that a number of modifications to the invention are possible without departing from the scope of the claims. For example, the precise configuration of the articulated joint 7, the actuator 16 and the anchor 8 can be varied as required.

It will be clear from the foregoing that the present invention provides an improved riser system which allows a dynamic riser to be assembled and left in a stable, standby condition ready for connection to a production vessel when it arrives in the field. This significantly reduces the time between arrival of the production vessel and the start of production, with consequent financial savings.

What is claimed is:

1. A riser system for connecting a seabed installation to a floating vessel, comprising a first conduit for conveying fluid and which is attachable at a first end to a seabed installation and comprises connector means at a second end, a second conduit for conveying fluid and which is attachable at a first end to a floating vessel and comprises connector means at a second end which is engageable with the connector means of the first conduit to allow fluid communication between the first and second conduits, articulation means joining the first and second conduits to allow relative rotation therebetween about a pivot axis whereby the first and second conduits are movable into alignment with one another to allow mating engagement of the respective connector means and out of alignment with one another to allow disengagement of the respective connector means.

2. A riser system as claimed in claim 1, further comprising anchor means operable to anchor the articulation means adjacent the seabed.

3. A riser system as claimed in claim 2, wherein the anchor means comprises a seabed installation releasably engageable with the first or the second conduit.

4. A riser system as claimed in claim 2, wherein the anchor means comprises a ballast weight releasably attached to the articulation means.

5. A riser system as claimed in claim 4, wherein the ballast weight is secured to the articulation means at a location displaced from the pivot point.

6. A riser system as claimed in claim 1, further comprising buoyancy means secured to the first end of the second conduit.

7. A riser system as claimed in claim 1, further comprising buoyancy means secured to the first conduit between the first and second ends.

8. A riser system as claimed in claim 1, further comprising actuator means operable to assist relative rotation of the first and second conduits about the pivot axis.

9. A riser system as claimed in claim 8, wherein the actuator means comprises a hydraulic ram.

10. A riser system as claimed in claim 1, wherein the first and second conduits each comprise a double-skinned structure.

11. A method of assembling a riser system for connecting a seabed installation with a floating vessel comprising the steps of:

a) providing first and second conduits each having first and second ends;

b) providing mating connector means at the respective second ends of the first and second conduits;

c) providing articulation means joining said first and second conduits adjacent said second ends to allow relative rotation about a pivot axis whereby the first and second conduits are movable into alignment with one another to allow mating engagement of the respective connector means and out of alignment with another to allow disengagement of the respective connector means; and d) attaching the first end of the first conduit to a seabed installation.

12. A method as claimed in claim 11, further comprising the step of anchoring the articulation means adjacent the seabed with anchor means.

13. A method as claimed in claim 12, further comprising the step of providing buoyancy means at the first end of the second conduit to allow the second conduit to float in a substantially vertical position above the anchor means.

14. A method as claimed in claim 13, further comprising the step of raising the first end of the second conduit to overcome said anchor means and to allow pivoting about the pivot axis to bring the connector means into mating engagement, and securing the first end of the second conduit to a floating vessel.

15. A method as claimed in claim 14, wherein the anchoring means is releasably engageable with the first or second conduit or the articulation means and the step of overcoming the anchor means comprises disengaging the respective conduit or the articulation means from the anchor means.

16. A method as claimed in claim 11, further comprising dimensioning the first and second conduits such that the articulation means is located at between 50% and 95% of the water depth below sea level.

17. A method as claimed in claim 11, further comprising providing buoyancy means on the first conduit between the first and second ends.

18. A method as claimed in claim 11, further comprising providing actuator means operable to assist relative rotation of the first and second conduits about the pivot axis.

* * * * *